US006185838B1

(12) United States Patent
Moore

(10) Patent No.: US 6,185,838 B1
(45) Date of Patent: Feb. 13, 2001

(54) CROSS FLOW HAND DRIER

(76) Inventor: Derek W. Moore, 44 Guiness Avenue, Toronto (Rexdale) Ontario (CA), M9W 3K9

( * ) Notice: Under 35 U.S.C. 154(b), the term of this patent shall be extended for 0 days.

(21) Appl. No.: 09/401,778

(22) Filed: Sep. 22, 1999

(51) Int. Cl.[7] ..... F26B 19/00
(52) U.S. Cl. ..... 34/202; 392/380; 392/381
(58) Field of Search ..... 34/90, 91, 201, 34/202, 427; 392/380, 381

(56) References Cited

U.S. PATENT DOCUMENTS

| | | | | |
|---|---|---|---|---|
| 2,634,514 | * | 4/1953 | Clemens | 34/243 |
| 2,646,629 | * | 7/1953 | Clemens | 34/243 |
| 2,761,222 | * | 9/1956 | Bennett | 34/202 |
| 3,305,938 | * | 2/1967 | Goldstein | 34/44 |
| 3,575,583 | * | 4/1971 | Brown | 219/370 |
| 3,643,346 | * | 2/1972 | Lester | 34/202 |
| 4,087,925 | * | 5/1978 | Bienek | 34/60 |
| 4,383,377 | * | 5/1983 | Crafton | 34/60 |
| 4,999,929 | * | 3/1991 | Dutton | 34/90 |
| 5,111,594 | * | 5/1992 | Allen | 34/1 X |
| 5,146,695 | * | 9/1992 | Yang | 34/90 |
| 5,459,944 | * | 10/1995 | Tatsutani et al. | 34/202 |
| 5,974,685 | * | 11/1999 | Hironaka | 34/202 |

* cited by examiner

*Primary Examiner*—Pamela Wilson
*Assistant Examiner*—Andrea M. Joyce

(57) ABSTRACT

A hand drier for drying the hands in a turbulent air flow region of cross flowing multiple air streams, and for recycling already heated air for reheating to conserve energy and having a housing and a fan in the housing to create air flow, scrolls for dividing the air flow into two air streams, and guiding them in opposite directions, a heater for heating the air, and, air outlets spaced apart from one another for receiving the air streams so as to redirect respective air streams from opposite directions and cause them to flow countercurrent in opposition to one another to produce a turbulent air flow where the two countercurrent air streams meet, in which the hands can be placed for drying.

10 Claims, 5 Drawing Sheets

CROSS FLOW HAND DRIER

FIELD OF THE INVENTION

The invention relates to hand driers such as are used in institutional and commercial washrooms, and in some public facilities, and in particular to such hand driers in which the air is warmed to procure rapid drying of the hands after washing.

BACKGROUND OF THE INVENTION

Hand driers usually consist of a housing containing a fan and a heater, usually powered by electricity. An air outlet or nozzle ejects a stream of heated air over the hands, usually from one end of the housing, or through a nozzle which can in many cases be swivelled around so that the air is directed to a desired location. Fresh air is usually inducted into the housing at a location remote from the air outlet. In this way the heated air is continuously dissipated into the ambient air in the room and its calorific values are lost, or in summer months simply add to the load on the air conditioning facilities in the building. The fresh air inducted is at ambient temperatures and must be rapidly warmed to the desired drying temperature. There is in effect a continuous demand for heat energy for the incoming air which is then immediately dissipated again. While it is true that such driers incorporate timers so that the actual duration of operation is cut off after the time has expired, there is none the less a considerable waste of energy. It also well known that persons may need to extend the timed operation, and simply repeatedly press the operating switch.

There is an additional disadvantage to conventional hand driers, in that the location of the air outlet is often so designed that the heated air flow stream spreads widely as it exits into the atmosphere, and much of the calorific value in the heated air stream never even reach the hands at all. Some designs have more efficient outlets so as to guide the air stream more narrowly, but in these cases the air stream may be so narrow that it impinges on only a portion of the hands and the user may have to move the hands so as to direct the air onto all areas of the skin. In all cases the direction of airflow is one way ie from the outlet towards the hands and out into the atmosphere. Thus the hands are dried only from one direction. The hands must be turned around and wiped over each other, as is well known. Unless this is done the hands will remain wet on the sides that do not face the air stream.

Clearly it is desirable to provide a hand drier which is both more efficient in its use of electrical energy, and in which the calorific value of the heated air is to some extent recovered by recycling the heated air, and in which the heated air stream is at the same time directed in such a manner as to dry all areas of the hands simultaneously, and quickly, and with a minimum of loss of heated air, and consequent loss of calories, to the atmosphere.

BRIEF SUMMARY OF THE INVENTION

With a view to providing a hand drier which addresses these conflicting problems the invention provides a hand drier having a housing, a fan in the housing and means for dividing the air flowing from the fan into at least two streams, and heating means for heating the air, and having at least two air outlets spaced apart from one another for receiving respective air streams from the housing, and being oriented so as to direct two air streams from opposite directions in opposition to one another so as to produce a turbulent air flow region therebetween in which the hands can be placed for drying, and having an air induction inlet located substantially intermediate the outlets through which air is inducted by the fan, thereby causing the fan to re-induct a substantial proportion of the already heated air flowing from the outlets and thus continuously recycling warm air and recovering at least some of the calorific value in the warm air, and having thermal control means in the housing for maintaining a constant internal air temperature during operation to prevent overheating caused by induction and reheating of already heated air.

The invention provides in one embodiment a housing with a central induction inlet opening and two outlets at opposite ends of the housing, directing two air streams across the exterior of the housing from opposite sides and procuring turbulent air circulation adjacent a region intermediate the two outlets, and in the general region of the air inlet opening so that turbulent warm air is inducted from the region of turbulence created by the opposition of the two air streams.

Preferably the two outlets are located below the housing and the inlet opening is located in an underside of the housing, between the outlets.

In one form the fan is a centrifugal fan mounted within the housing to rotate on a vertical axis, and there are two scrolls or air collectors within the housing to collect air flowing from around the fan and to direct the air into two air streams flowing towards opposite ends of the housing.

In a particularly convenient design one outlet, and one end wall of the housing, are molded integrally together out of thermoplastic material, and the outlet and end walls are of identical design for both ends of the housing so as to provide an economical form of construction.

Each molding will preferably incorporate a support flange for supporting an air intake grill, to still further save in construction.

The various features of novelty which characterize the invention are pointed out with more particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

IN THE DRAWINGS

DESCRIPTION OF A SPECIFIC EMBODIMENT

As explained above the invention provides a hand drier in which at least two air streams are directed towards one another to produce a zone or region of turbulent air circulation between the outlets. The hands when placed in this turbulent region will be dried more rapidly than in the conventional hand drier air stream in which the air exits from only one outlet in one direction and in a diffuse pattern.

Recycling of warm air reduces the heating load on the air heaters and saves energy.

Figure 1:
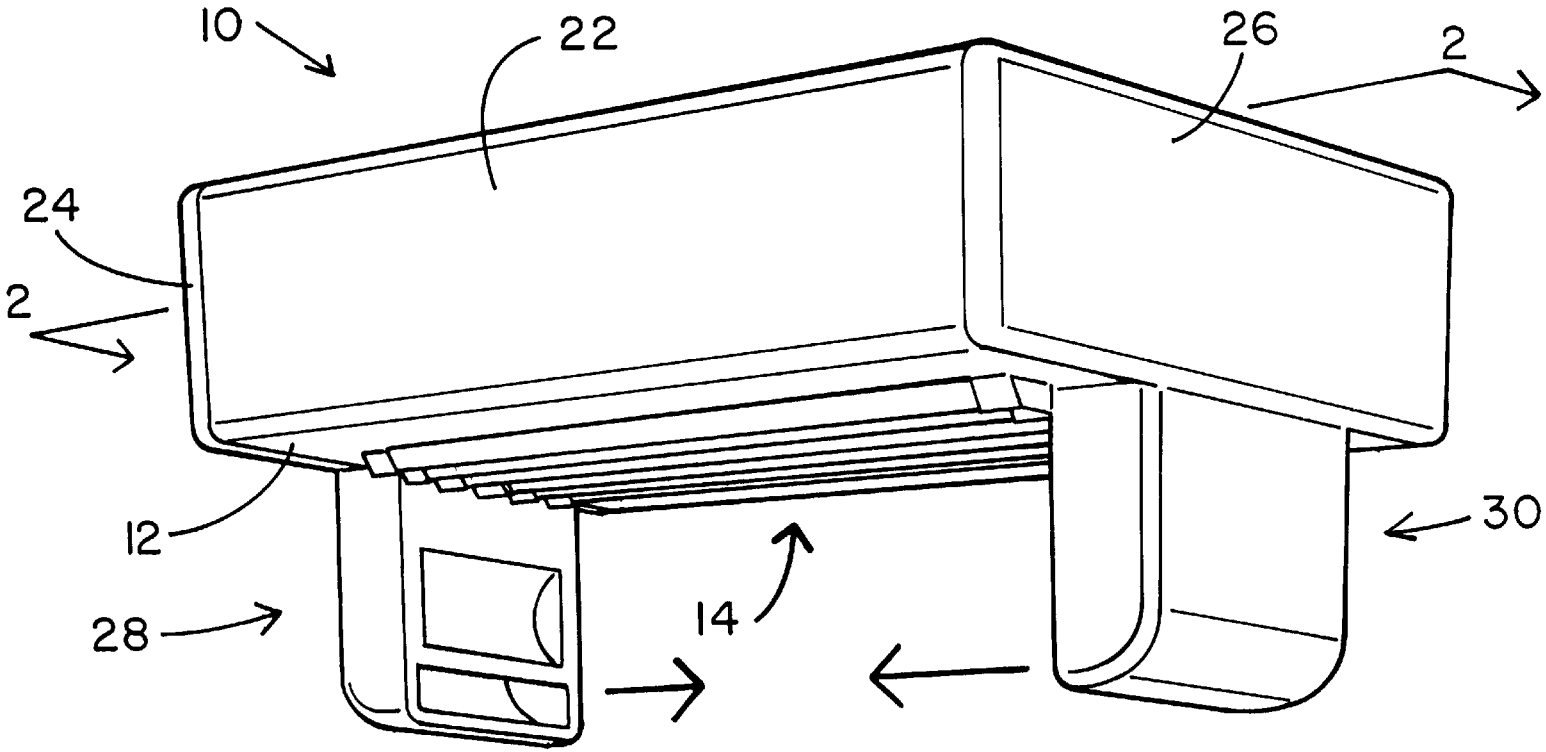
FIG. 1 is a lower perspective of one embodiment of hand drier illustrating the invention.
Figure 2:
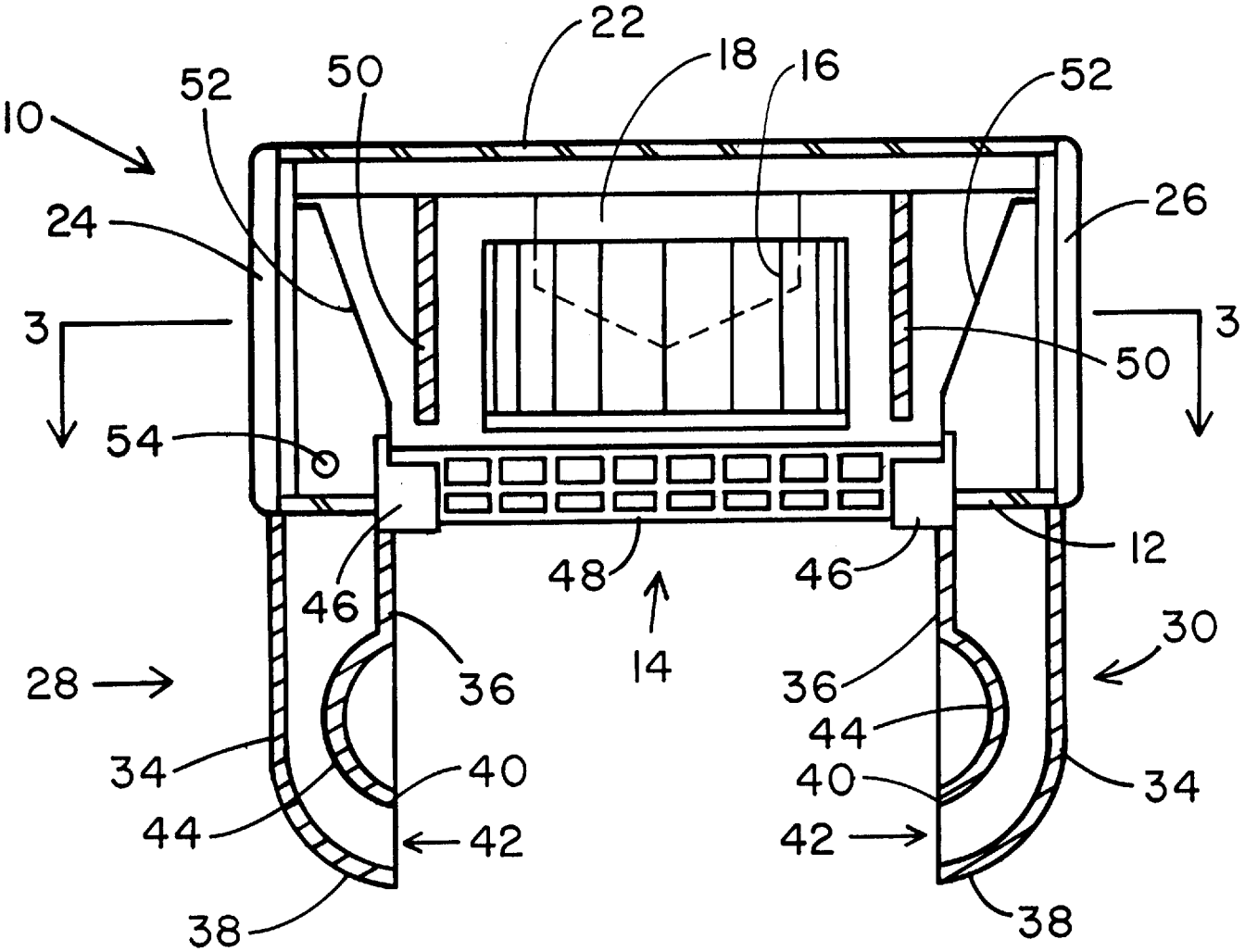
FIG. 2 is a vertical section along line 2—2 of FIG. 1.
Figure 3:
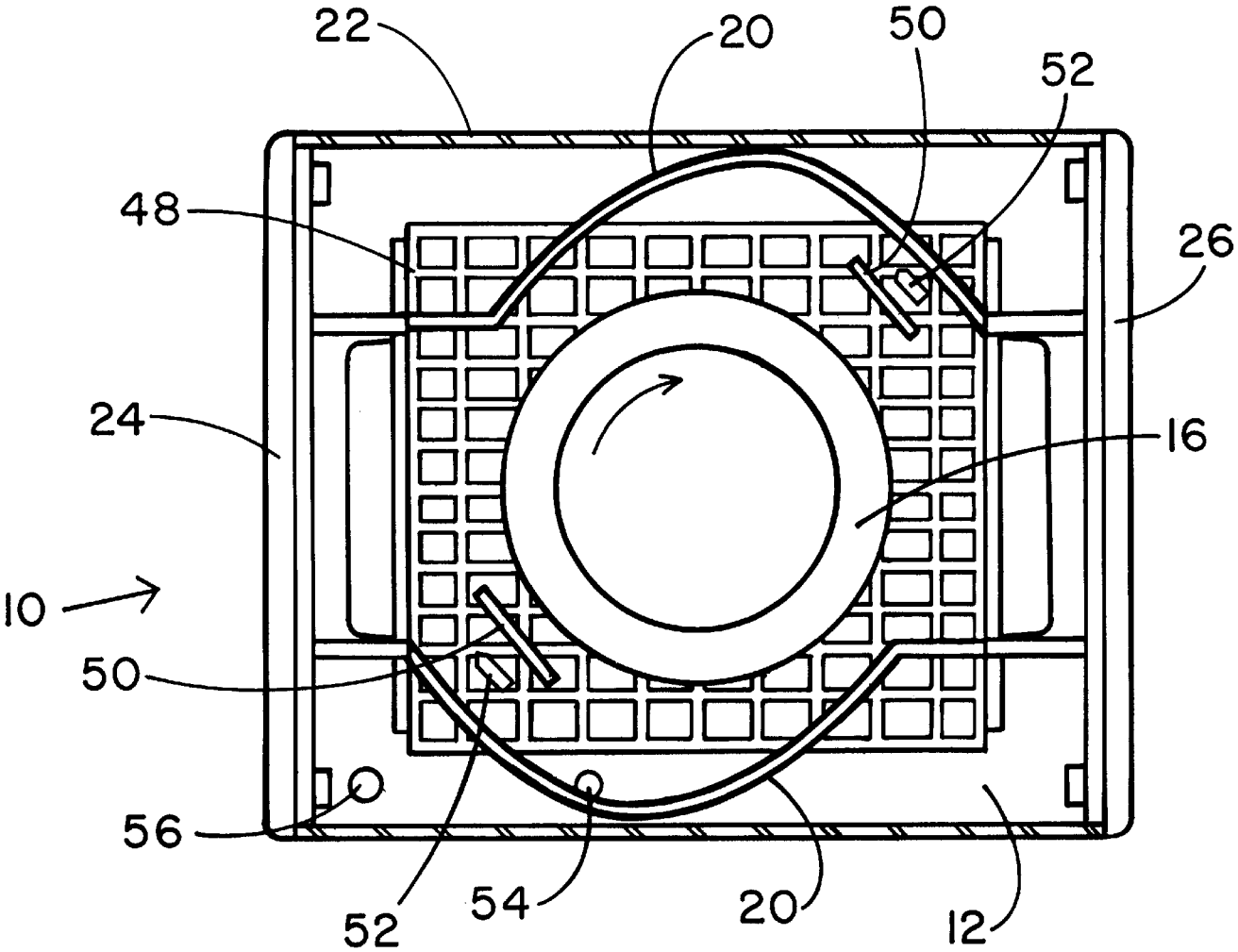
FIG. 3 is a horizontal section along the line 3—3 of FIG. 2.
Figure 4:
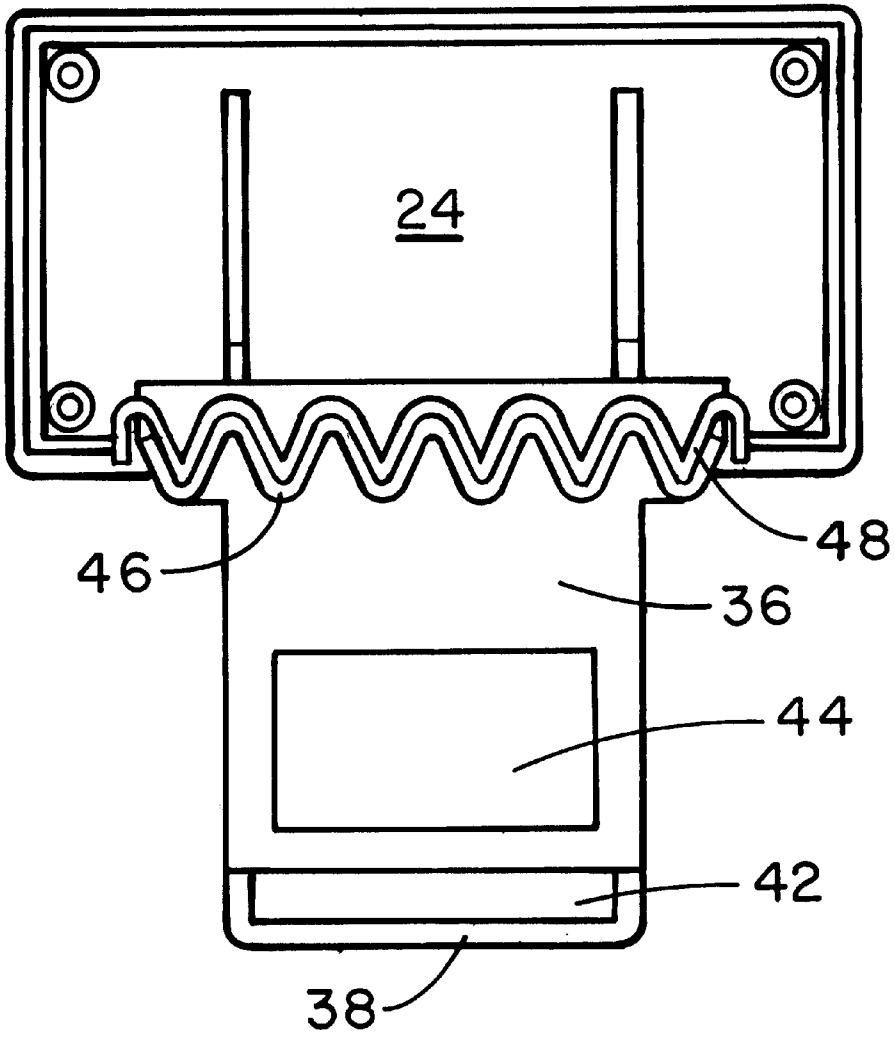
FIG. 4 is an elevation of one end wall and air guide channel, shown separated from the housing.
Figure 5:
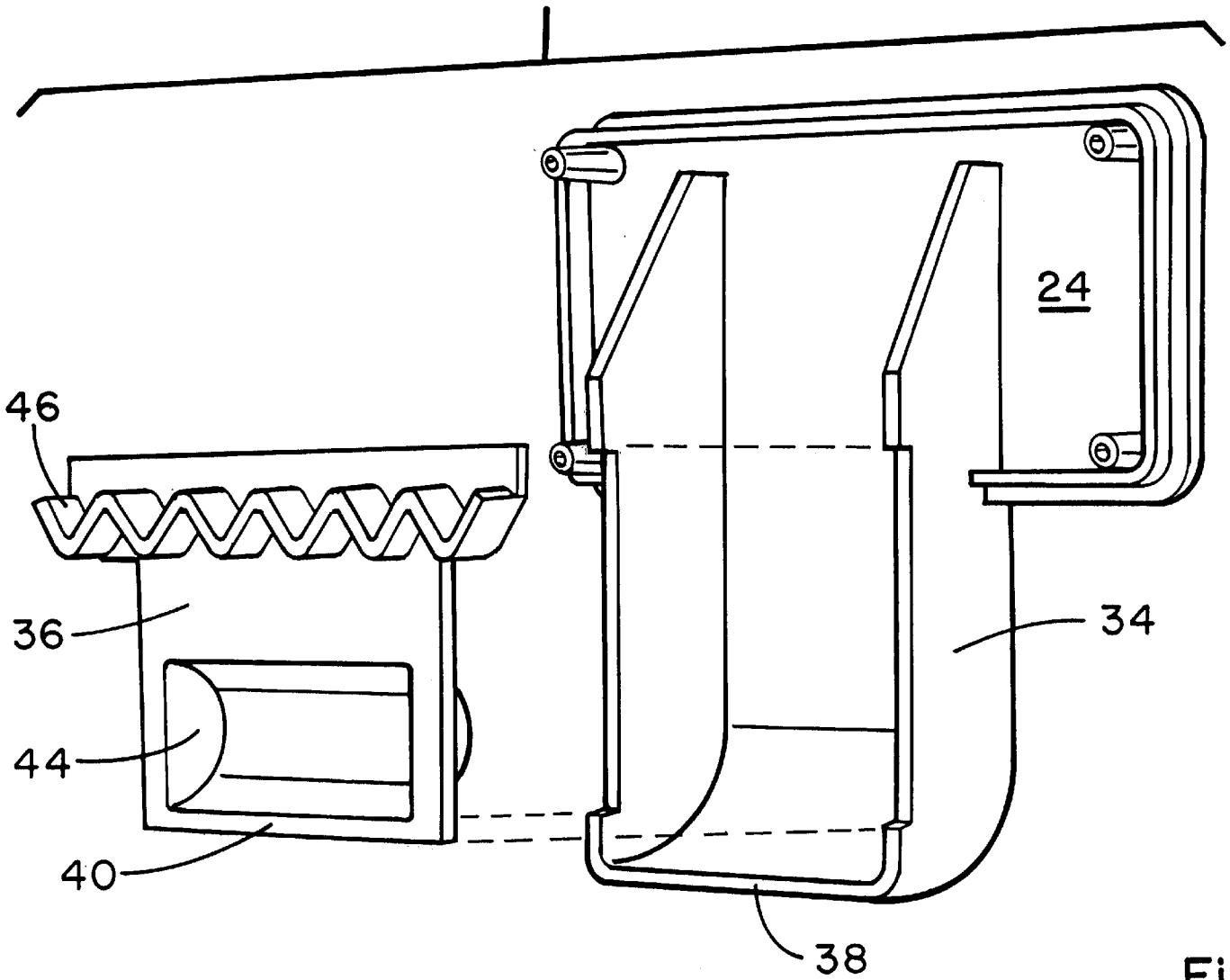
FIG. 5 is an exploded perspective of one end wall and air guide channel of the hand drier of FIG. 1.

In the illustrated embodiment the hand drier is shown as 10 and comprises a frame 12 formed in this case of sheet metal. A central opening 14 is formed in the frame for induction of air. Mounted on frame 12 is a centrifugal fan 16 which is driven by motor 18. Fan 16, operates to draw air in through opening 14 and to eject air around the periphery of fan 16. Scrolls or air collectors 20 are mounted on frame 12 adjacent opposite sides of fan 16. Scrolls 20 are of generally spiral shape and function to collect air exiting from the fan and to direct it into two air streams flowing towards respective opposite ends of frame 12. Housing 22 covers fan 16 and motor 18 and is secured to frame 12. At each end of housing 22 there are respective end walls 24 and 26. These walls are of generally rectangular shape in elevation and are secured at opposite ends of the housing (FIGS. 4 and 5).

Extending downwardly from frame 12, at each end are respective air guides 28 and 30. In this embodiment the guides 28–30 are formed integrally with their respective end walls 24–26. They are formed by integral molding of thermoplastic material. In order to provide an air passageway in each of the air guides 28–30 the air guides are formed as outer guide walls 34 which are of generally rectangular channel shape in section and are formed integrally with end walls 24–26 as continuous downward extensions thereof. Partial inner guide wall portions 36 also formed of molded thermoplastic material, are secured to the outer guide walls 34 and thus define generally rectangular air guide passages extending downwardly. The lower ends 38 of outer guide walls 34 are curved around an arc of about ninety degrees so as to guide the air flow across the underside of the frame 12. The inner guide walls 36 are formed with complementary curved portions 40 which cooperate with lower ends 38 to define air outlets 42 which are directed at about ninety degrees to the plane of outer guide walls 34.

Inner guide wall portions 36 are formed with inwardly radiussed constrictions 44 which narrow the air passages and force the air flow to speed up in this region. Inner guide wall portions 36 are formed with generally sinusoidal shaped ledges 46, extending inwardly from opposite sides of opening 14. A metal grill 48 is supported on ledges 46. Grill 48 is formed for example of wire mesh, or any other suitable material, which defines air flow spaces for inflow of inducted air. Grill 48 prevents the insertion of any objects up through opening 14 which might interfere with the fan. Such air will flow upwardly through air opening 14 being drawn upwardly by the operation of fan 16.

In this way two air streams are created being collected from around the fan 16 by the scrolls 20 and which is thus directed to flow out into the respective air guides 28–30, formed by the two pairs of outer and inner guide walls. The air streams are directed from the two air outlets 42, in opposition to one another across the lower portion of the hand drier and flow countercurrent to one another.

The effect is to create a region of substantial air turbulence where the two air streams meet, approximately midway between the two pairs of outer and inner walls.

When the hands are placed in this region the turbulent air flow will effectively dry the skin all over the hands in a rapid and efficient manner.

The air is heated within the housing 22 by any suitable means such as heater coils 50. Suitable electrical power circuits are provided such as are well known in the art. Temperature sensors 52 are provided to detect the temperature of the heated air, and to regulate the supply of power to the heaters and thus maintain the temperature of the warm air, during operation, and keep it at a safe upper limit to prevent overheating.

A remote presence sensor, such as infra red sensor 54, and infra red source 56, well known per se, are located within housing 22 and are directed to sense the presence of the hands when they are placed between the air outlets. In order to reduce the maximum temperature of the body of the drier, and to minimize the temperature rise of the working parts, the fan and the heaters are controlled separately. Switch means (not shown) are provided by which both the fan and the heaters are turned ON when the hands are sensed. They both remain ON while the hands remain in position, and for 2 seconds after the hands are removed. The start of this 2 second period is continuously refreshed until the hands are removed. At this time the switch means will turn the heaters OFF. The fan continues to run for 2 seconds more and is then itself turned off by the switch means. This ensures that all components cool down on shutdown and prevents a temperature surge.

The foregoing is a description of a preferred embodiment of the invention which is given here by way of example only. The invention is not to be taken as limited to any of the specific features as described, but comprehends all such variations thereof as come within the scope of the appended claims.

What is claimed is:

1. A hand dryer, for drying hands in a turbulent air flow region of cross-flowing multiple air streams and for recycling heated air, comprising:

a housing formed by a frame with a central opening;

a fan mounted on said frame in said housing;

a motor for driving said fan to create air flow;

air flow dividing means for dividing the air flow from said fan into at least two air streams and guiding said at least two air streams in opposite directions;

heating means for heating air;

said hand dryer further comprising:

at least two air outlets spaced apart from one another for receiving said at least two air streams from said housing, said air outlets being oriented to redirect said air streams, respectively, from the housing, said air streams flowing in opposite directions, countercurrent in opposition to one another;

said turbulent air flow region created at intersection of at least two countercurrent air streams wherein said hands are placed for drying;

an integral one-piece thermoplastic molding formed by at least one air outlet and at least one end wall of the housing, said molding is identical for each side of the housing, wherein molding comprises an outer wall, said outer wall has a curved end portion, an inner wall attached to said outer wall, said inner wall is formed by at least one inwardly radiussed air flow constriction and at least one generally sinusoidal-shaped ledge extending upwardly from opposite side of said central opening, and a support flange; and air flow recycling means for recycling a portion of heated air for reuse in at least one of said countercurrent air streams.

2. A hand dryer as claimed in claim 1, said central opening comprises an air inlet in said hand dryer substantially intermediate said at least two air outlets through which air is inducted by said fan, said fan re-inducts a substantial proportion of the heated air flowing from said at least two air outlets and continuously recycles the heated air to recover a portion of the calorific value of the heated air.

3. A hand dryer as claimed in claim 1, further comprising thermal control means in said housing for maintaining a constant internal air temperature during operation of said hand dryer to prevent overheating caused by induction of said fan and said recycling of the heated air.

4. A hand dryer as claimed in claim 1, wherein said at least two air outlets are located at opposite ends of said housing, said air outlets direct said at least two air streams across exterior of said housing from opposite sides and procure turbulent air circulation adjacent a region intermediate said at least two outlets, said region including an air induction opening in said turbulent air flow region of the heated air, said heated air is inducted from said turbulent air flow region created by opposition of said at least two air streams.

5. A hand dryer as claimed in claim 4, wherein said at least two air outlets are located below said housing and said air induction opening is located in an underside of said housing between said at least two air outlets.

6. A hand dryer as claimed in claim 1, wherein said fan is a centrifugal fan mounted on said frame in said housing to rotate, said frame including two scrolls to collect air from around said centrifugal fan and to direct air into said at least two air streams flowing towards opposite ends of said housing.

7. A hand dryer as claimed in claim 1, further comprising an air intake grill, wherein said air intake grill is attached to said support flange to provide support to said air intake grill.

8. A hand dryer as claimed in claim 1, further comprising an infrared presence sensor mounted in said housing and oriented towards region between said at least two air outlets, said sensor being activated by the presence of hands in the region between said at least two air outlets, wherein activating said sensor starts said motor and said heating means.

9. A hand dryer as claimed in claim 1, further comprising an infrared presence sensor mounted in said housing and oriented towards region between said at least two air outlets, said sensor being deactivated by the absence of hands in the region between said at least two air outlets, wherein deactivating said sensor stops said heating means and said motor.

10. A hand dryer as claimed in claim 9, further comprising heater control means for switching off heater a predetermined time after removal of hands from the region between said at least two air outlets, said heater control means thereafter switching off said motor to progressively shutdown said heating means and thereafter shutdown said fan.

* * * * *